United States Patent [19]

Hansen

[11] 4,449,490

[45] May 22, 1984

[54] CONCENTRIC INTAKE AND EXHAUST VALVE ASSEMBLY

[75] Inventor: Craig N. Hansen, Minnetonka, Minn.

[73] Assignee: Hansen Engine Corporation, Minnetonka, Minn.

[21] Appl. No.: 379,637

[22] Filed: May 19, 1982

[51] Int. Cl.[3] ..... F01L 1/28

[52] U.S. Cl. ..... 123/79 C; 123/48 A

[58] Field of Search ..... 123/79 C, 79 L, 48 A

[56] References Cited

U.S. PATENT DOCUMENTS

Re. 24,851 8/1960 Buchi ..... 123/79 C 2,439,618 4/1948 Cloutier ..... 123/79 C 2,970,581 2/1961 Georges ..... 123/48 A

FOREIGN PATENT DOCUMENTS 13757 of 1912 United Kingdom ..... 123/79 C

*Primary Examiner*—Craig R. Feinberg

*Assistant Examiner*—David A. Okonsky

*Attorney, Agent, or Firm*—Burd, Bartz & Gutenkauf

[57] ABSTRACT

An internal combustion engine having a cylinder bore providing a combustion chamber, and a piston located in the cylinder bore. A head mounted on the cylinder has concentric intake and exhaust valves operable to control the flow of gas into and out of the combustion chamber.

23 Claims, 20 Drawing Figures

CONCENTRIC INTAKE AND EXHAUST VALVE ASSEMBLY

FIELD OF INVENTION

The invention is directed to gas control devices for use with internal combustion engines and air compressors. The invention is specifically directed to a concentric intake and exhaust valve assembly for controlling the flow of gas, as an air/fuel mixture, into and out of a chamber.

BACKGROUND OF INVENTION

Conventional internal combustion engines and air compressors utilize separate valves for controlling the inlet gas and the exhaust gas from each combustion or compression chamber. Each of the valves is reciprocally mounted on the head of a valve in head engine and in the block of a L-head engine. Valve springs are used to hold the valves in their closed positions. A cam shaft and separate rocker arms are used to sequentially open and close the intake and exhaust valves. The exhaust valve is subjected to high temperature exhaust gas that is purged from the combustion chamber. Over a period of time, the exhaust valves deteriorate and burn. The size of the intake and exhaust valves is limited, as they must open into the top of the combustion chamber. The fuel and air mixture is not introduced into the center portion of the chamber, nor is the exhaust gas exhausted from the central area of the chamber. This reduces the charging and purging efficiencies of the engine. The concentric intake and exhaust valve assembly of the invention is designed to alleviate the disadvantages of the separate intake and exhaust valves of an internal combustion engine.

SUMMARY OF INVENTION

The intake and exhaust valve assembly of the invention is useable with an internal combustion engine, such as a fourcycle, multi-cylinder engine, or an air compressor for controlling the flow of gas into and out of the engine or compressor. The engine has conventional reciprocating pistons operable to compress an air/fuel mixture in a combustion chamber and purge the burned gas from the combustion chamber. The engine has a head means mounted on a block for covering the combustion chamber. The head means accommodates the intake and exhaust valve assembly and supports valve operating structures, such as rocker arms and push rods, operable to sequentially operate the intake and exhaust valves of the concentric intake and exhaust valve assembly.

The intake and exhaust valve assembly has a first valve slidably mounted on the head means for movement to open and closed positions. The first valve has a sleeve and an outwardly directed annular rim. The rim engages a valve seat mounted on the head means when the valve is in the closed position. Biasing means, as a coil spring, move the first valve to the closed position. A second valve is located concentrically within the first valve. The second valve has an outwardly directed flange engageable with the rim of the first valve when the second valve is in the closed position. Biasing means, such as a spring, move the second valve to its closed position. The first valve functions to control the flow of gas, such as exhaust gas, from the chamber. When open, the first valve provides a large outlet passage allowing rapid purging of exhaust gas from the chamber. The second valve functions to control the flow of gas, such as air or an air/fuel mixture into the chamber. The gas flowing past the flange of the second valve and rim of the first valve cools both valves during the gas intake phase of operation of the engine.

Cam operated structures are used to sequentially open and close the first and second valves. These structures include rocker arms associated with the first and second valves. One or more cam shafts having cams are used to sequentially operate the rocker arms thereby operating the valves. The cam shafts are drivably connected to the crankshaft of the engine or air compressor so that the valves operate in timed relation with the movement of the pistons.

In one form of the invention, the second valve has a sleeve slidably mounted on a tubular member. The tubular member has a passage accommodating a spark plug. Adjustable means mounts the tubular member on the head means so that the location of the spark plug relative to the chamber can be changed. This permits adjustment of the compression ratio of each cylinder of the engine.

IN THE DRAWINGS

DESCRIPTION OF PREFERRED EMBODIMENTS

Figure 1:
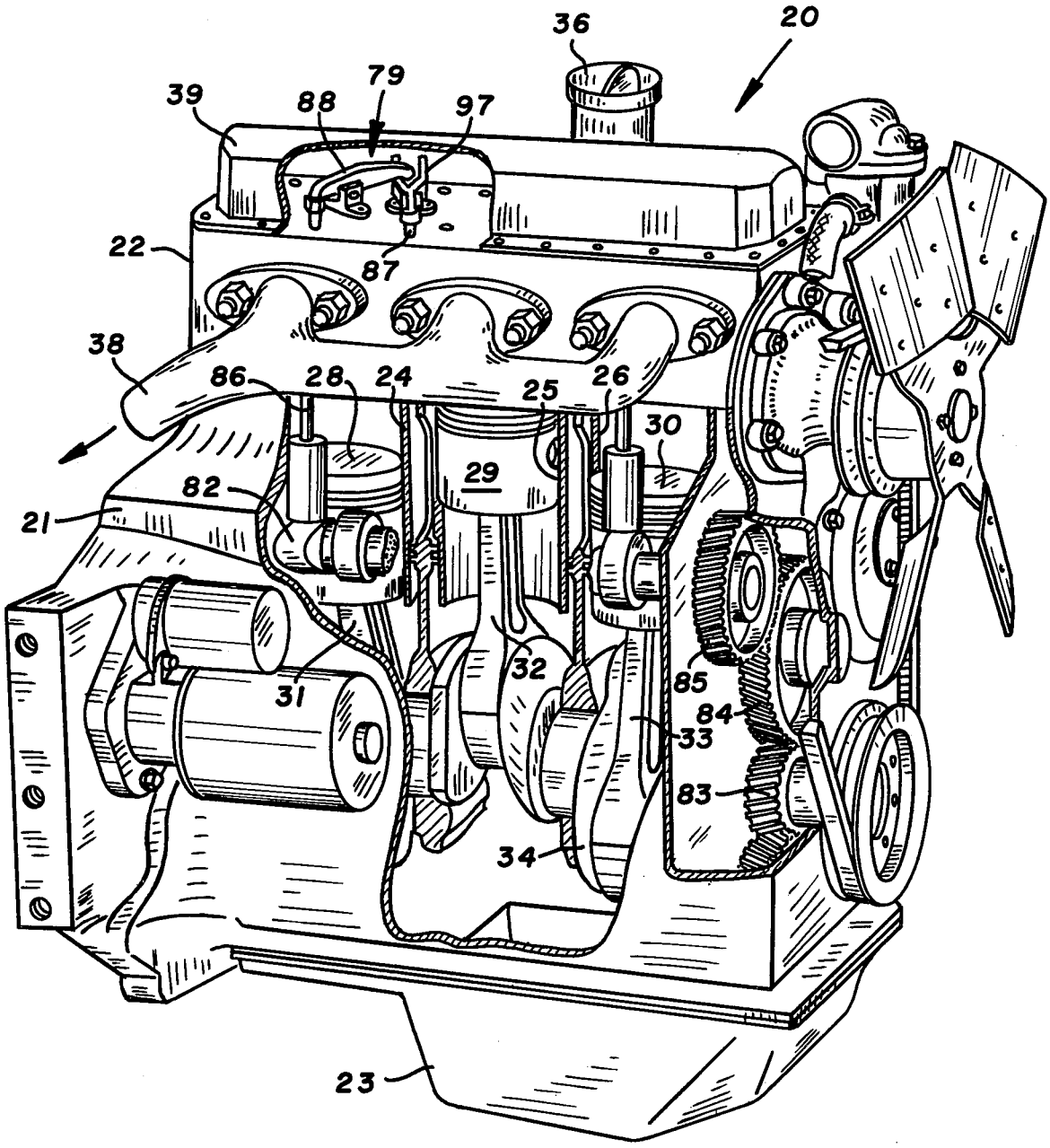
FIG. 1 is a perspective view, partly sectioned, of an internal combustion engine equipped with concentric intake-exhaust valve assemblies of the invention.
Figure 2:
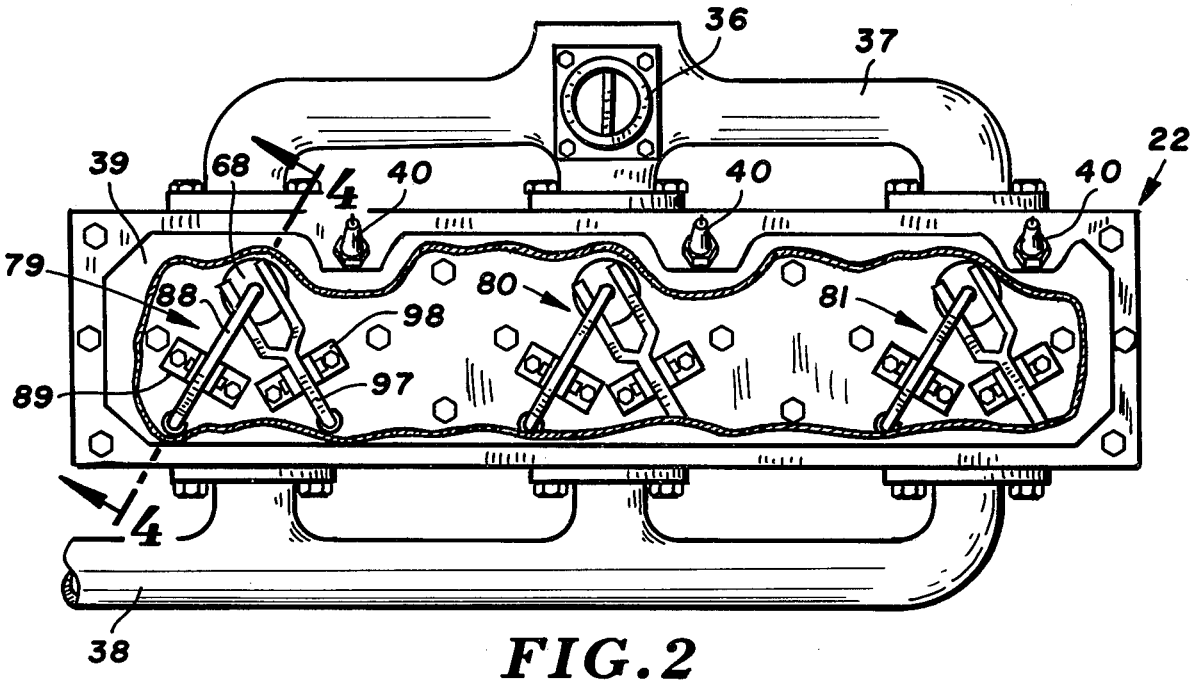
FIG. 2 is a top plan view of FIG. 1 with the valve cover broken away.

Referring to FIG. 1, there is shown an internal combustion engine indicated generally at 20 having a block 21. A head 22 is secured to the top of the blocks with conventional head bolts (not shown). An oil pan 23 is attached to the bottom of block 21. Block 21 has three upwardly directed cylinders 24, 25, and 26 slidably accommodating reciprocating pistons 28, 29, and 30. Piston rods 31, 32, and 33 connect pistons 28, 29, and 30 to a crankshaft 34 rotatably mounted on block 21. As seen in FIG. 2, a carburetor 36 is mounted on an intake mainfold 37. Manifold 37 is attached to head 22. An exhaust manifold 38 is attached to the opposite side of head 22. The top of head 22 supports a valve cover 39 to enclose the rocker arm structures 79, 80, and 81 for operating the concentric intake and exhaust valve assemblies of the invention.

Figure 4:
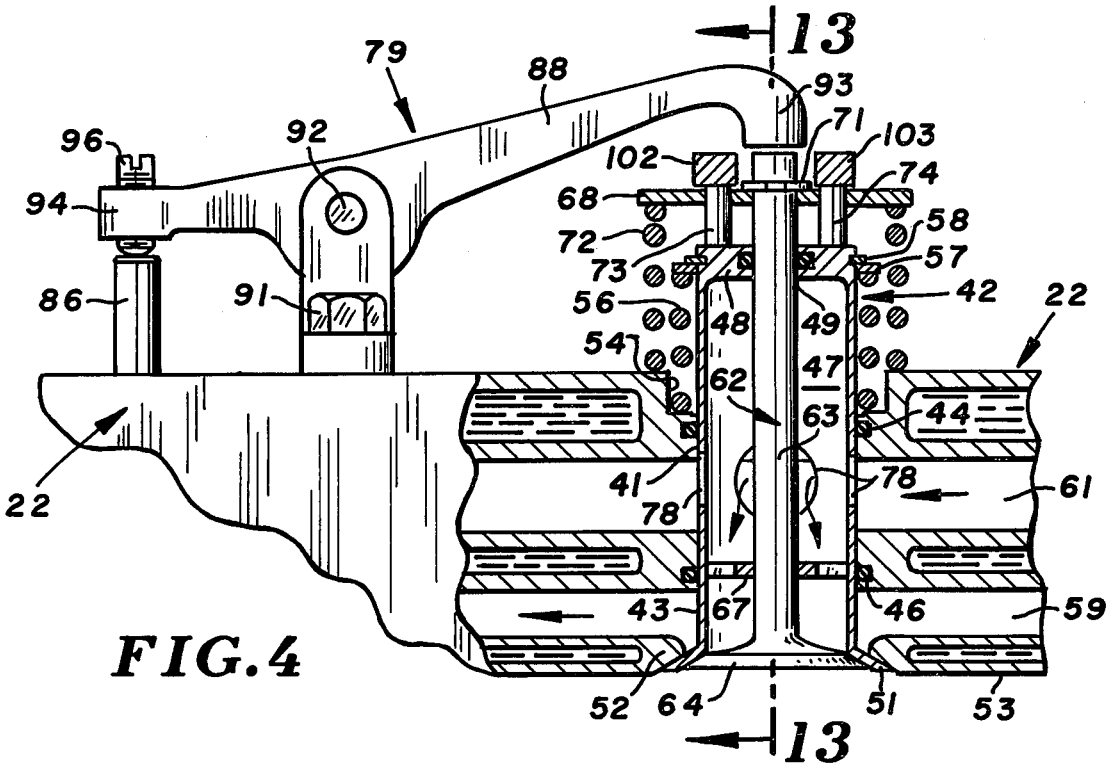
FIG. 4 is an enlarged sectional view taken along the line 4—4 of FIG. 2 showing the concentric intake-exhaust valve assembly in the closed position.

As shown in FIG. 4, head 22 has a single upright bore 41 accommodating a combined intake and exhaust valve assembly of the invention indicated generally at 42. Assembly 42 has an upright sleeve or tubular member 43 slidably located in bore 41. A pair of ring seals 44 and 46 mounted in grooves in head 22 engage the outer surface sleeve 43, to minimize the leakage of gas into the space enclosed by the valve cover 39. Sleeve 43 has a passage or chamber 47 and a top end 48 closing the upper end of chamber 47. End 48 has a hole 49 in the center thereof. The lower end of sleeve 43 has an outwardly and downwardly tapered circular flange or rim 51 open to the combustion chamber of the cylinder. Flange 51 engages a tapered valve seat 52 in the bottom of head 22.

The top of head 22 has a recess 54 concentric with bore 41 accommodating a first coil spring 56. Spring 56 surrounds the upper end of sleeve 43 and engages a washer 57 surrounding end 48. A retainer ring 58, such as a C-snap ring, holds washer 57 in assembled relation with sleeve 43. The upper end of spring 56 engages washer 57 to bias sleeve 43 and flange 51 on the lower end thereof in an upward closed position.

The lower portion of head 22 has an exhaust passage 59 leading to exhaust manifold 38. The upper portion of head 22 has an intake passage 61 leading to the intake manifold 37. When flange 51 is engaged with seat 52, the exhaust passage 59 is closed.

Figure 5:
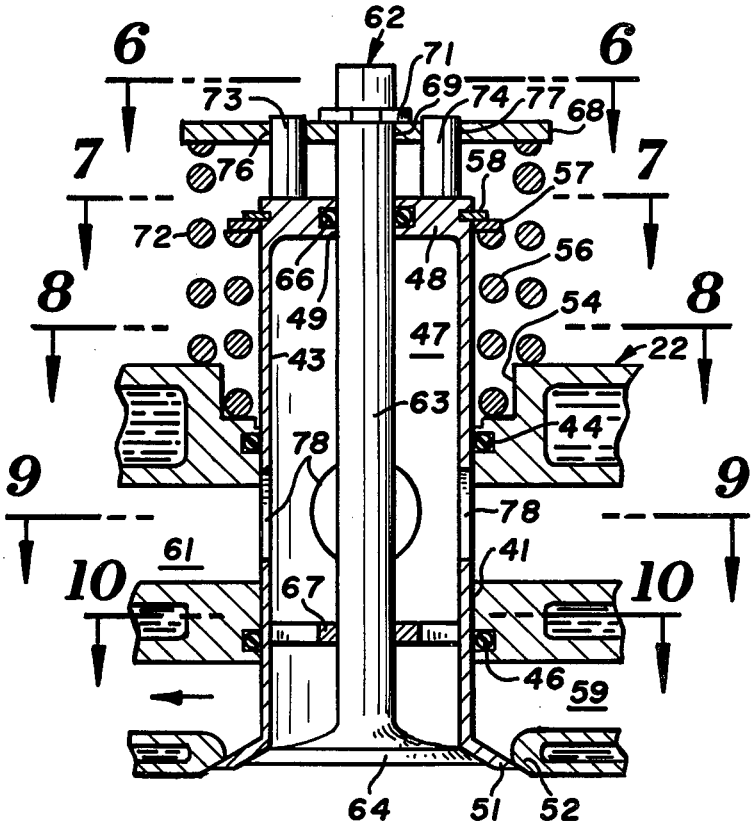
FIG. 5 is an enlarged sectional view similar to FIG. 4 of the concentric intake-exhaust valve assembly in the closed position.
Figure 6:
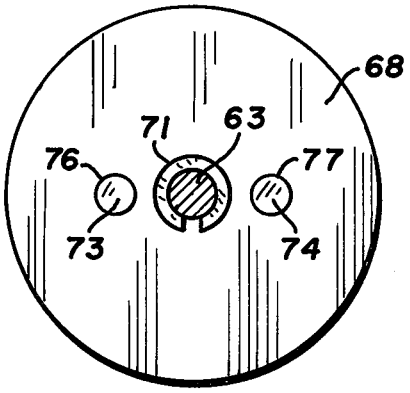
FIG. 6 is a sectional view taken along the line 6—6 of FIG. 5.
Figure 7:
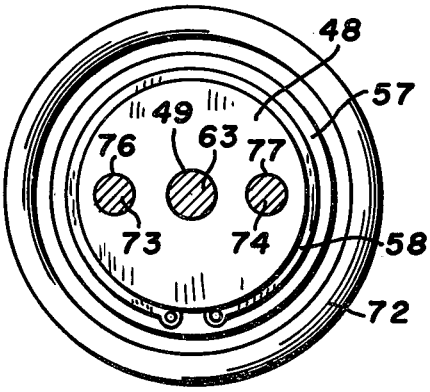
FIG. 7 is a sectional view taken along the line 7—7 of FIG. 5.
Figure 8:
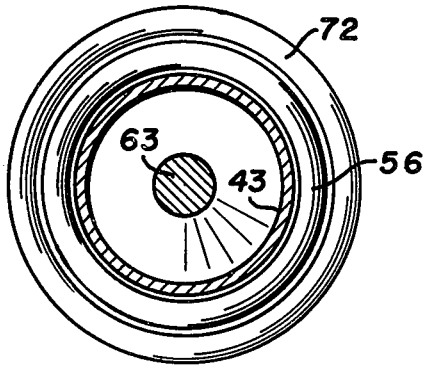
FIG. 8 is a sectional view taken along the line 8—8 of FIG. 5.

An intake valve indicated generally at 62, as shown in FIGS. 4 and 5, is mounted on the end 48. Intake valve 62 has an elongated rod-like stem 63 integrally joined to a cylindrical head 64. Head 64 engages the inside tapered surface of flange 51 when valve 62 is in its closed position. The upper end of stem 63 projects through a hole 49 in end 48. A ring seal 66 mounted in end 48 engages stem 63. The lower portion of sleeve 43 accommodates a spider or spacer ring 67 that centers the lower portion of stem 63 with respect to sleeve 43. Intake valve 62 is biased to its closed position by a second coil spring 72. The lower end of coil spring 72 bears against the top of head 22. The upper end of coil spring 72 engages a circular disc or plate 68. Plate 68 has a central hole 69 accommodating the upper end of stem 63. A C-shaped snap ring 71 mounted on stem 63 holds plate 68 in assembled relation with stem 63. As shown in FIGS. 4–7, a pair of upright projections 73 and 74 extend upwardly from end 48 through holes 76 and 77 in plate 68. The projections 73 and 74 allow the intake valve 62 to be opened separately from the exhaust valve sleeve 43.

Figure 9:
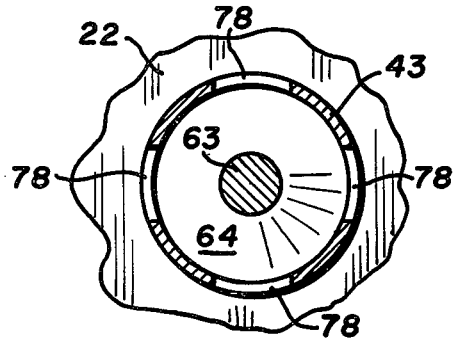
FIG. 9 is a sectional view taken along the line 9—9 of FIG. 5.
Figure 10:
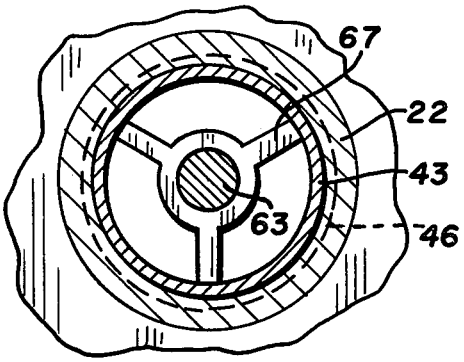
FIG. 10 is a sectional view taken along the line 10—10 of FIG. 5.
Figure 11:
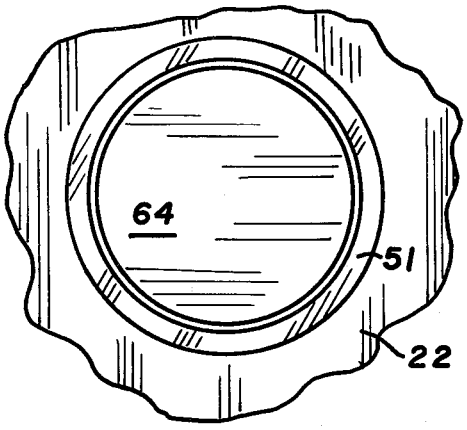
FIG. 11 is a bottom view of FIG. 5.

As shown in FIGS. 5 and 9, the mid-section of sleeve 43 has a plurality of openings or side holes 78 in communication with inlet passage 61. Holes 78 allow the air/fuel mixture to flow from passage 61 into valve chamber 47. When the concentric intake and exhaust valve assembly is used with a diesel engine, only air will flow in intake passage 61 and through holes 78 and valve passage 47 to the combustion chamber of the engine.

Engine 20 has three concentric intake and exhaust valve assemblies identical to valve assembly 42. As shown in FIG. 2, rocker arm assemblies indicated generally at 79, 80, and 81, are operable to sequentially operate the intake valve and exhaust valve of the valve assemblies. Returning to FIG. 1, a cam shaft 82 having intake and exhaust cams is rotatably mounted on block 21. Timing gears 83, 84, and 85 drivably connect the cam shaft 82 to engine crankshaft 34. Each rocker arm assembly is operably connected to cam shaft 82 with a pair of push rods 86 and 87 reciprocally mounted in block 21 and head 22. The upper ends of the push rods 86 and 87 project upwardly from block 22 and operatively engage the rocker arm assemblies 79, 80, and 81.

Figure 3:
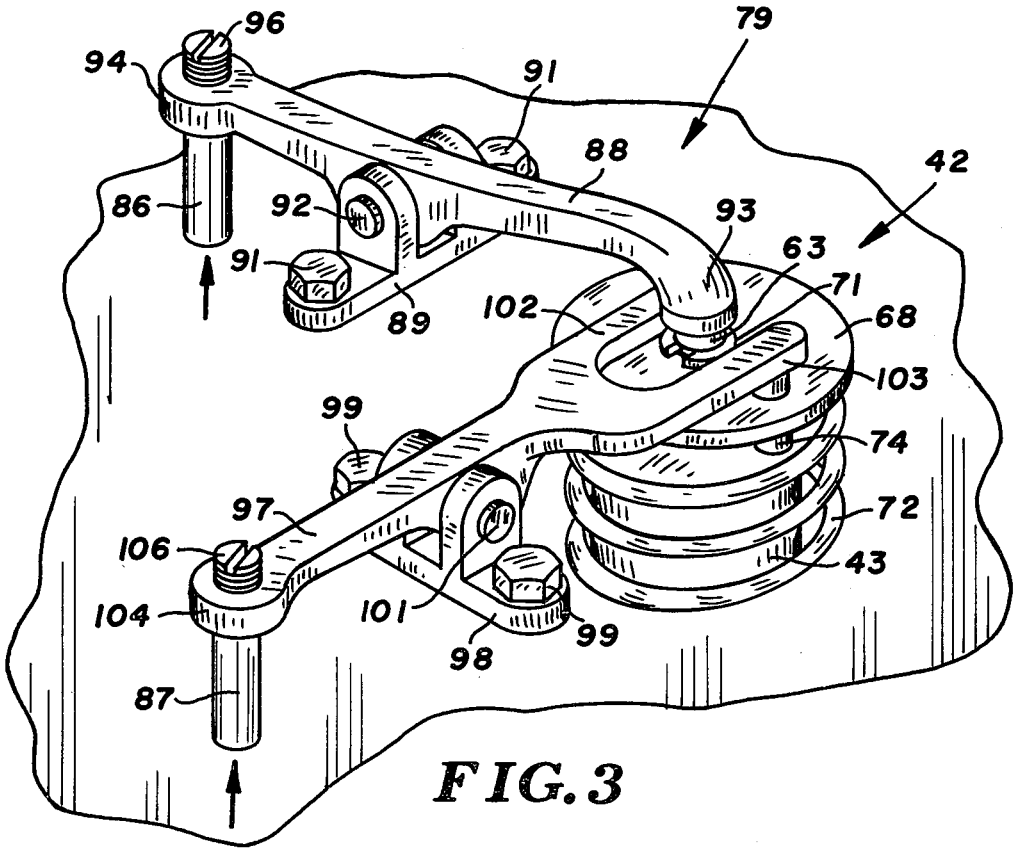
FIG. 3 is an enlarged perspective view of the rocker arms and upper end of concentric intake-exhaust valve assembly.

Rocker arm assembly 79 is shown in detail in FIG. 3. Rocker arm assemblies 80 and 81 are identical in structure and function to rocker arm assembly 79. The following description is directed to rocker arm assembly 79 and its sequential operation of concentric intake and exhaust valve assembly 42. Rocker arm assembly 79 has a first rocker arm 88 pivotally mounted on a support 89 with pivot pin 92. A pair of bolts 91 attach the support to the top of head 22. Rocker arm 88 has a first end or head 93 located adjacent the top valve stem 63. Arm 88 has a second end 94 supporting an adjusting screw 96. Screw 96 engages the upper end of push rod 86. The screw 96 is adjustable to adjust the clearance between head 93 and upper end of valve stem 63.

A rocker arm assembly 79 has a second rocker arm 97 angularly disposed with respect to the first arm 88. Arm 97 is pivotally mounted on a support 98 with a pivot pin 101. A plurality of bolts 99 secure support 98 to the top of head 22. Arm 97 has a pair of fingers 102 and 103 located over plate 68 adjacent the upper ends of projections 73 and 74. Arm 97 has a second end 104 accommodating a screw 106. Screw 106 engages the upper end of push rod 87. Screw 106 can be rotated to adjust the clearance between fingers 102 and 103 and the upper ends of projections 73 and 74. On rotation of cam shaft 82, push rods 86 and 87 sequentially pivot rocker arms 88 and 97 to open the intake valve and exhaust valve of the concentric valve assembly 42. Springs associated with the intake valve and exhaust valve bias the valves to their closed positions.

Referring to FIGS. 4 and 5, intake and exhaust valve assembly 42 shows both the intake valve and exhaust valve in the closed position. Valve rim 51 is located in engagement with valve seat 52 blocking the exhaust passage 59. The head 64 of the intake valve is in engagement with valve rim 51 blocking valve passage 47. Holes 78 in sleeve 43 allow the intake fluid, such as air and fuel mixture, to flow into valve chamber 47. The relatively cool intake fluid cools the intake and exhaust valves and raises the temperature of the intake fluid.

Figure 12:
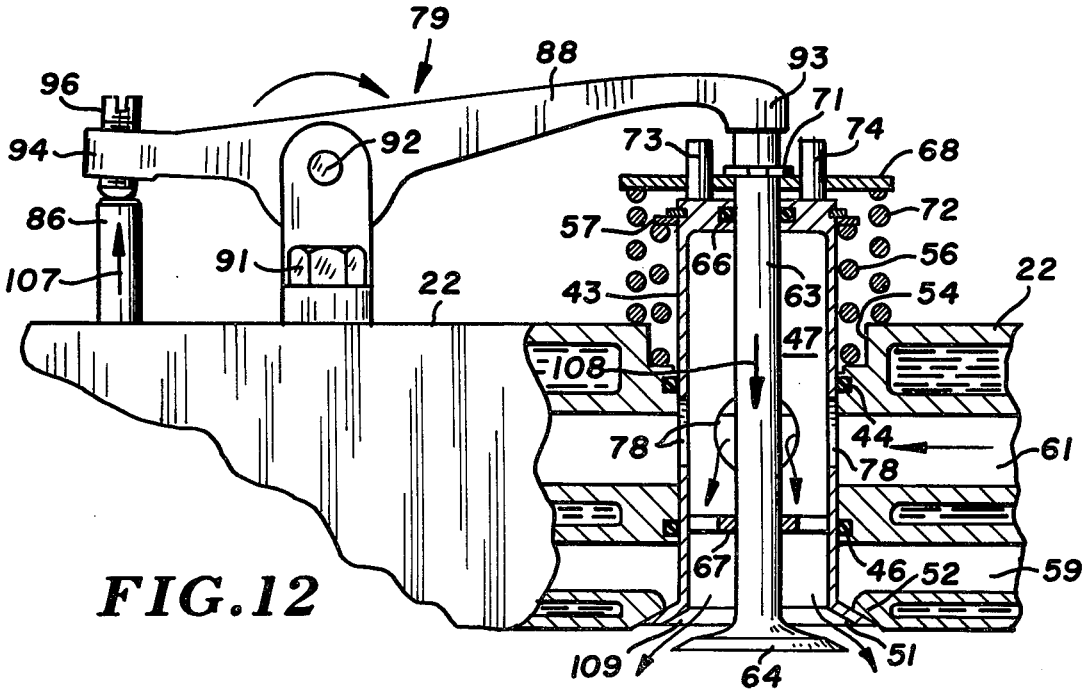
FIG. 12 is a sectional view similar to FIG. 4 showing the intake valve in the open position and exhaust valve in the closed position.
Figure 13:
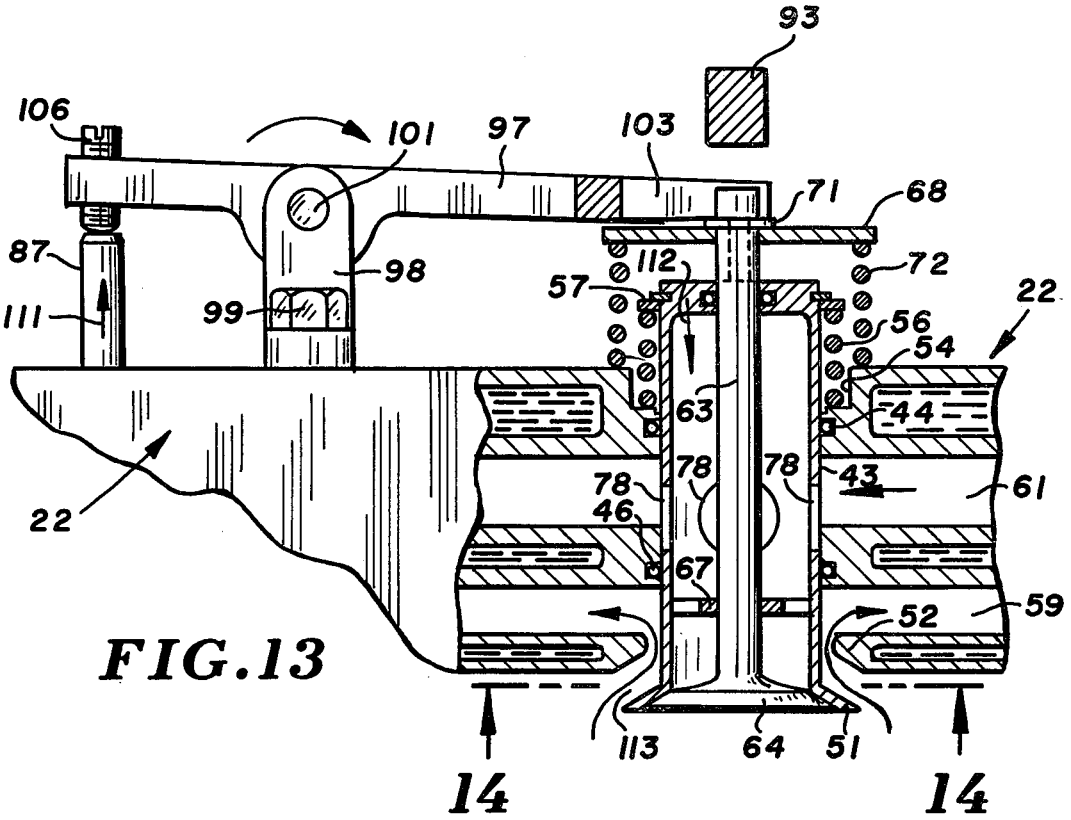
FIG.13 is a sectional view similar to FIG. 4 showing the intake valve closed and exhaust valve open.

Referring to FIG. 12, rocker arm assembly 79 is operated in response to movement of push rod 86. Push rod 86 is moved in an upward direction, as indicated by arrow 107, by the cam on cam shaft 82, to pivot rocker arm 88 in a clockwise direction. The head 93 of rocker arm 88 engages the top of valve stem 63 pushing the valve stem in a downward direction, as indicated by the arrow 108. This moves valve head 64 downwardly into the combustion chamber away from the exhaust valve rim 51 forming an annular fuel and air intake passage 109. The air and fuel mixture flows through the inlet passage 61 through the holes 78 in sleeve 43, the passage 47, and into the combustion chamber through the annular intake passage 109. The air/fuel mixture flowing past the exhaust valve rim 51 cools the exhaust valve rim and valve seat 52. Valve head 54 is preferably located centrally of the combustion chamber so that the air/fuel charge is uniformally distributed in the combustion chamber. At the completion of the intake stroke of the piston, the push force of arm 88 is terminated. Coil spring 72 moves intake valve head 64 to a closed position, as shown in FIG. 4. Piston 28 moves up in the cylinder 24 to compress the fuel and air mixture in the piston chamber. The compressed fuel and air mixture is ignited by a spark generated by sparkplug 40 as the piston approaches the head at center. The burning air/fuel mixture creates the power stroke of the engine. On completion of the power stroke, the piston moves upwardly into the cylinder to exhaust the gases from the cylinder. During the exhaust stroke, the exhaust valve is opened, as shown in FIG. 13.

Figure 14:
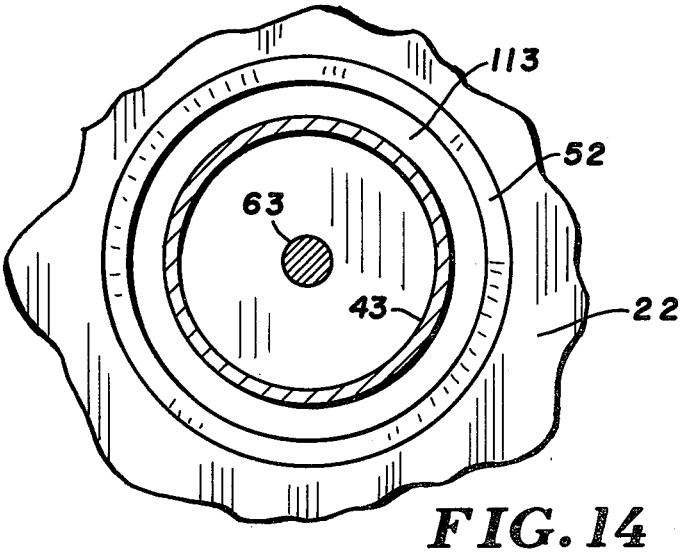
FIG. 14 is an enlarged sectional view taken along the line 14—14 of FIG. 13.

Rocker arm 97 is moved in a clockwise direction on upward movement of push rod 87, as indicated by arrow 111. A cam on cam shaft 82 moves push rod 111. Rocker arm 97 moves sleeve 43 in a downward direction, as indicated by the arrow 112. Valve rim 51 moves downwardly away from seat 52 forming therewith a large annular exhaust passage 113, as shown in FIG. 14. The exhaust gases in the cylinder are forced through the exhaust passage 113 into the exhaust passage 59 of head 22 leading to exhaust manifold 38. The intake valve head 64 remains closed, as it reciprocates with sleeve 43. The exhaust valve is returned to the closed position in response to the combined biasing force of the inner spring 56 and outer spring 72. As shown in FIG. 4, when intake and exhaust valve assembly 43 is in the closed position, the holes 78 in the sleeve 43 are in communication with the inlet passage 61. This insures a supply of fuel/air mixture to the sleeve passage 47. As shown in FIG. 12, with the intake valve head 64 in the open position, holes 78 remain in communication with the inlet passage 61 to insure a continuous flow of air/fuel mixture through passage 47.

Figure 15:
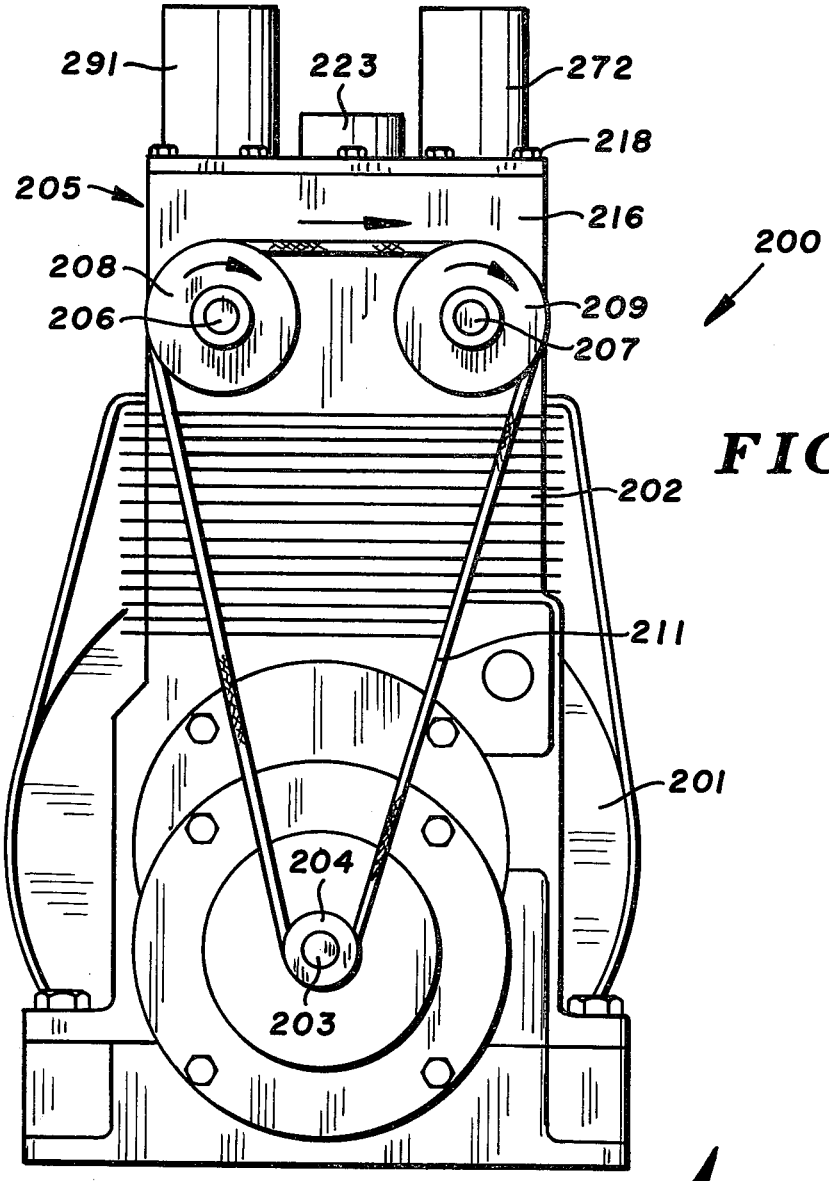
FIG. 15 is a side elevational view of a second embodiment of the concentric intake and exhaust valve assembly of the invention in an assembled relation with a single cylinder internal combustion engine.

Referring to FIG. 15, there is shown an internal combustion engine indicated generally at 200 having a block 201 supporting an upright air cooled cylinder 202. The cylinder 202 has a conventional upright bore providing a combustion chamber 212 accommodating a reciprocating piston (not shown). The piston is connected with a conventional connecting rod to a crankshaft 203 rotatably mounted in block 201. A pulley 204 is mounted on crankshaft 203.

A head indicated generally at 205 having a modification of the concentric intake and exhaust valve assembly of the invention is mounted on top of cylinder 202 and secured thereto with conventional head bolts (not shown). The head 205 has a pair of cam shafts 206 and 207 rotatably mounted for rotation about axes that are generally parallel to the axes of crankshaft 203. Pulleys 208 and 209 are drivably secured to shaft 206 and 207. An endless timing belt 211 is trained about pulleys 204, 208, and 209, whereby shafts 206 and 207 are rotated in a timed relationship relative with crankshaft 203. Cam shafts 206 and 207 are rotated at one-half the speed of rotation of crankshaft 203.

Figure 17:
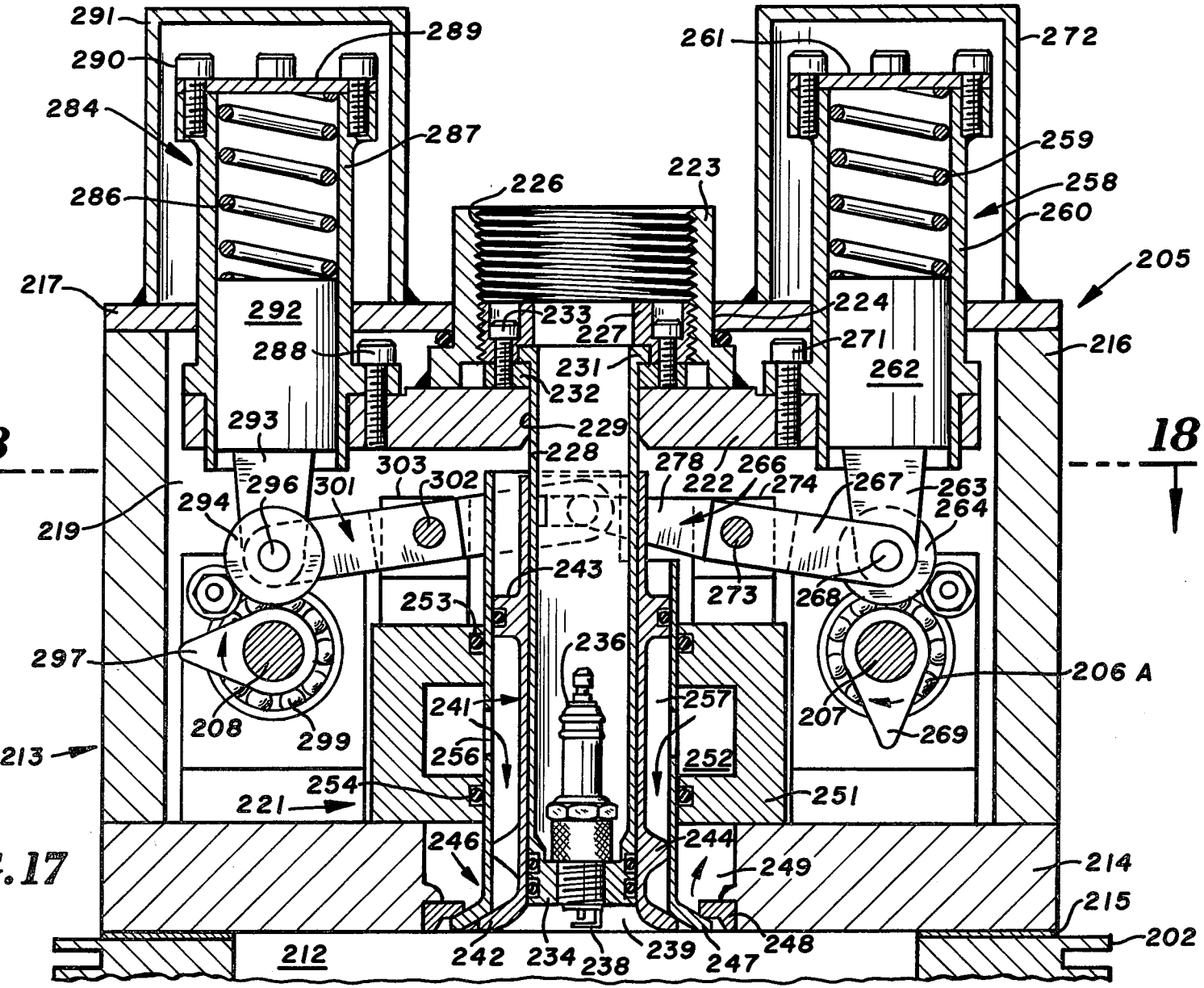
FIG. 17 is an enlarged sectional view taken along the line 17—17 of FIG. 16.

Head 205 has a generally rectangular box-shaped housing indicated generally at 213 mounted on top of the cylinder 202. As shown in FIG. 17, head 205 is located over combustion chamber 212 in cylinder 202. Conventional head bolts (not shown) secure head 205 to cylinder 202.

Figure 16:
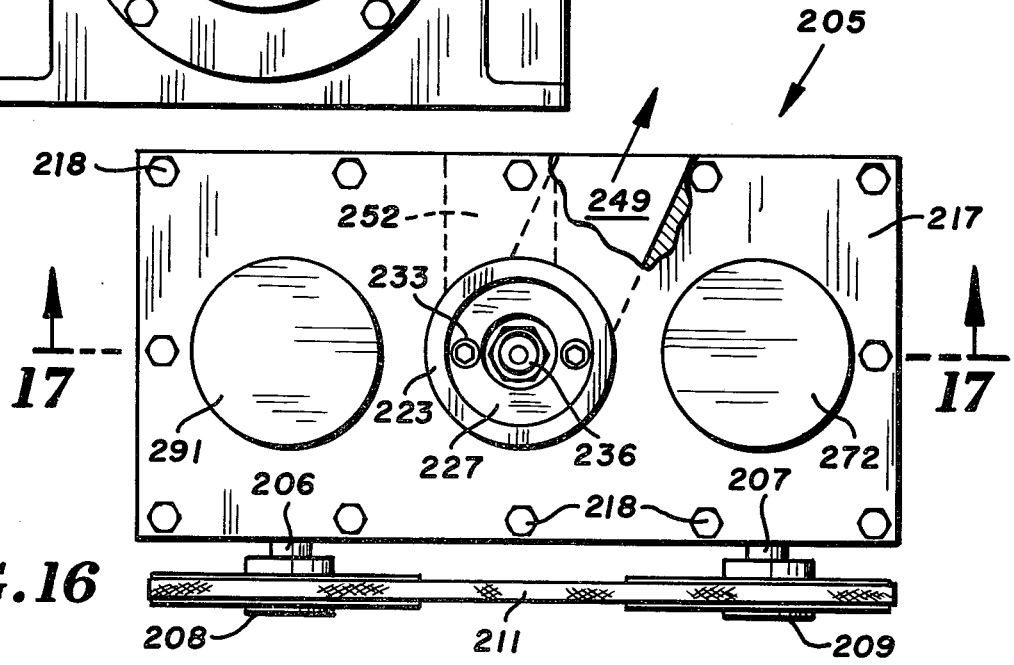
FIG. 16 is a top view with a portion broken away of FIG. 15.

Housing 213 has a generally flat bottom wall 214 located on a gasket 215 on top of cylinder 202 surrounding combustion chamber 212. Upright side walls 216 are mounted on bottom wall 214. A top wall 217 is mounted on top of the side walls 216. A plurality of bolts 218, shown in FIG. 16, secure top wall 217 to side wall 216. Walls 214, 216, and 217 enclose a chamber 219 accommodating the concentric intake and exhaust valve assembly of the invention indicated generally at 221.

A generally flat plate or support 222 is located in chamber 219 below top wall 217. A support 22 is secured to a sleeve 223 extended upwardly through a hole 224 in top wall 217. Sleeve 223 has a threaded central passage 226 accommodating a threaded ring 227. An elongated cylindrical tubular member 228 extends downwardly from ring 227 through a hole 229 in support 222. Member 228 has an outwardly directed annular lip 231 that is clamped onto the ring 227 with a washer 232 and a plurality of bolts 233.

The lower end of the tubular member 228 has a threaded body 234 accommodating a conventional sparkplug 236. Spark-plug 236 positioned in the passage of tubular member 228 has conventional electrodes 238 located in an ante-chamber 239 open to the top of the mid-portion of combustion chamber 212.

Ring 227 can be rotated, thereby moving ring 227 and tubular member 228 in a longitudinal direction. This changes the location of sparkplug electrodes 238 relative to the combustion chamber 212. When member 228 is moved upwardly in head 205, the size of the ante-chamber 239 is increased, thereby changing the compression ratio of the engine. When the sparkplug electrodes 238 are located up in the head the ignition of the air/fuel mixture starts in the ante-chamber. The flame front is propelled centrally of the combustion chamber along the axis of the piston. The results in efficient combustion of the air/fuel mixture without knock.

An intake valve 241 is slidably mounted on the cylindrical tubular member 228. Intake valve 241 is an elongated cylindrical sleeve having a lower end terminating in an outwardly directed continuous annular flange or rim 242. Valve 241 has an upper annular continuous rib 243 and a plurality of circumferentially spaced lower projections 244. A sleeve exhaust valve 246 is slidably mounted on rib 243 and projections 244. Exhaust valve 246 is a cylindrical member having a lower end terminating in an outwardly directed continuous annular flange 247. Flange 242 of intake valve 241 engages flange 247 when intake valve 241 is closed. Exhaust valve flange 247 engages an annular seat 248 mounted on bottom wall 214. Annular seat 248 surrounds the entrance to an exhaust passage 249. The exhaust passage 249 is in the bottom wall 214 and extends outwardly to a conventional muffler (not shown).

Exhaust valve 246 is reciprocally mounted in an intake manifold 251 having an intake passage 252. The valve 246 extends through holes surrounded by sealing rings 253 and 254 in intake manifold 251. The mid-section of valve 246 has a plurality of ports 256 that allow air/fuel mixture to flow from manifold passage 252 into a valve passage 257 leading to combustion chamber 212.

Figures 18, 19, 20:
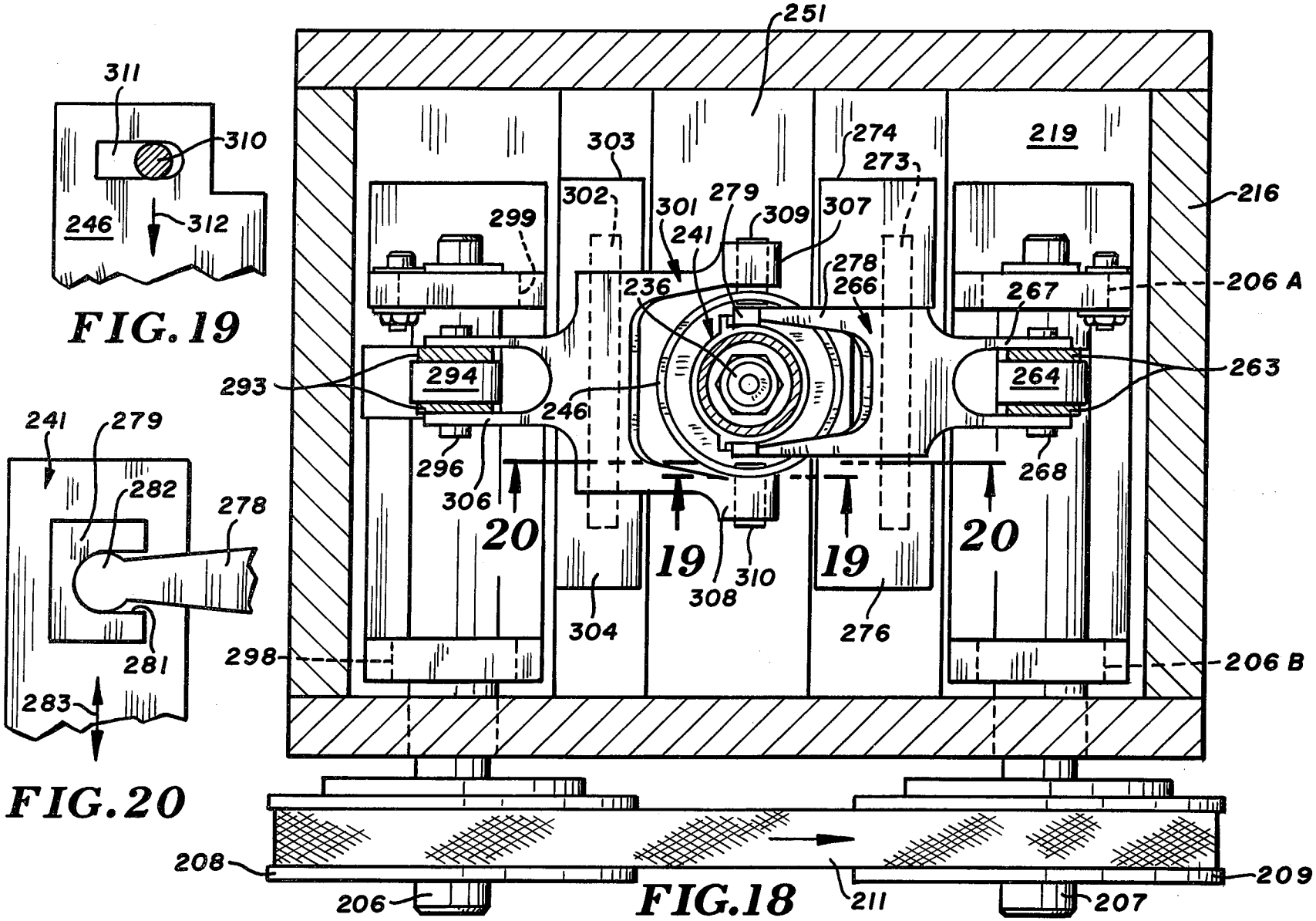
FIG. 18 is a sectional view taken along the line 18—18 of FIG. 17.
FIG. 19 is an enlarged sectional view taken along the line 19—19 of FIG. 18.
FIG. 20 is an enlarged sectional view taken along the line 20—20 of FIG. 18.

The intake valve 241 is maintained in a closed position with a biasing unit indicated generally at 258. Biasing unit 258 has a coil spring 259 located within a cylindrical sleeve 261. Spring 259 engages a reciprocating piston or plug 262 located in the bottom end of sleeve 261. The lower end of piston 262 has a pair of downwardly directed ears 263 rotatably supporting a roller or follower 264. A lever indicated generally at 266 movably connects the ears 263 with the intake valve 241. Lever 266 has a pair of first fingers 267 connected to ears 263 with a pin 268. Roller 264 is located between ears 263 and rotates on pin 268. Roller 264 is biased into engagement with a cam 269 mounted on cam shaft 209. As shown in FIG. 18, cam shaft 207 is rotatably mounted on a pair of bearings 206A and 206B located in suitable bearing blocks mounted on bottom wall 214. A sleeve 260 is mounted on the support 222 and secured thereto with a bolt 271. A cover plate 261 attached to the upper end of sleeve 260 retains spring 259 within sleeve 260. The upper end of sleeve 260 is enclosed within a cap mounted on top wall 217.

The mid-section of lever 266 is pivotally supported on a transverse pivot pin 273. Opposite ends of the pivot pin are mounted on supports 274 and 276 attached to the top of intake manifold 251. Lever 266 has a pair of second fingers 278 extended adjacent opposite sides of the upper end of the intake valve 241. As shown in FIG. 20, projections 279 secured to opposite sides of inner valve 241 have pockets 281. The ends of the second fingers 278 have semi-circular portions 282 that fit into pockets 281. On rotation of the cam 269, a large portion of the cam will engage roller 264 and rotate the lever 266 in a counterclockwise direction. This forces the intake valve 241 in a downward direction opening the valve. As soon as the high portion of the cam 269 leaves roller 264, spring 259 will bias the lever 266 and rotate it in a clockwise direction. This moves the intake valve 241 in an upward direction to its closed position, as shown in FIG. 17. The arrow 283, in FIG. 20, shows the reciprocating motion of intake valve 241.

Exhaust valve 246 is operatively associated with a second biasing unit indicated generally at 284 to bias exhaust valve 246 in a closed position, as shown in FIG. 17. Biasing units 284 include a coil spring 286 located within a sleeve 287. The lower end of sleeve 287 is mounted on the support 222 and secured thereto with a bolt 288. The top of sleeve 287 is closed with a cover 289. A plurality of bolts 290 secure cover 289 to sleeve 287. A cap 291 mounted on top wall 217 covers the biasing unit 284.

A piston or movable member 292 is reciprocally located in the lower end of sleeve 287. Spring 286 biases piston 289 in a downward direction. A pair of ears 293 secured to the bottom of piston 292 are located on opposite sides of a roller or cam follower 294. A pin 296 rotatably mounts roller 294 on ears 293. Roller 294 engages a cam 297 mounted on cam shaft 208. As shown in FIG. 18, cam shaft 208 is rotatably mounted on a pair of bearings 298 and 299 located in suitable bearing blocks mounted on bottom wall 214.

A lever indicated generally at 301 operatively connects piston 292 with exhaust valve 246 so that on reciprocating movement of piston 292 the lever will rotate to move exhaust valve 246 between its open and closed positions. As shown in FIG. 18, lever 301 is pivotally mounted on a pin 302. Opposite ends of the pin 302 are attached to supports 303 and 304 mounted on intake manifold 251. Lever 301 has a pair of first fingers 306 extended on opposite sides of ears 293. Pin 296 extends through holes in fingers 306. Lever 301 has a second pair of fingers 307 and 308 extended through opposite sides of the exhaust valve 246. The ends of the fingers 207 and 208, as shown in FIG. 18, have inwardly directly pins 309 and 310 that extend into slots in the exhaust valve 246. As shown in FIG. 19, the slot 311 has an elongated shape and accommodates pin 310. On rotation of the cam 297, the lever 301 is pivoted in a clockwise direction moving valve 246 in a downward direction or open position, as indicated by the arrow 312. When the exhaust valve 246 is open, it also moves the intake valve 228 downwardly into combustion chamber 212. This rotates lever 266 and moves piston 262 upwardly against the biasing force of the spring 259. Thus, both springs 259 and 286 function to return exhaust valve 246 to its closed position, as shown in FIG. 17.

In the operation of internal combustion engine 200, cam shafts 208 and 209 are simultaneously rotated in the same direction of rotation of the crankshaft 203. The timing belt 211 entrained over the pulleys 208 and 209 simultaneously rotates the cam shafts 206 and 207. Cams 269 and 297, as shown in FIG. 17, have a 90- degree relative orientation so that initially intake valve 228 is opened as the piston moves down in the combustion chamber 212. This draws the air/fuel mixture into the combustion chamber. The air/fuel mixture flows through passage 252 in intake manifold 251 through ports 256 in exhaust valve 246. The mixture flows through the valve passage 257 into the upper end of the combustion chamber 212. The relatively cool air/fuel mixture cools the exhaust valve flange 247 as it flows into the combustion chamber. The air/fuel mixture has an annular flow pattern that is generally concentric with the combustion chamber. This provides for a substantially uniform air/fuel distribution in the combustion chamber and efficient combustion.

The valves 228 and 246 remain closed during the compression of the air/fuel mixture in the combustion chamber 212. Sparkplug 286 is used to ignite the compressed air/fuel mixture and combustion chamber 212. The initial ignition commences in ante-chamber 239 accommodating electrodes 238 of the sparkplug 236. Sparkplug 236 is centrally located on the top of the combustion chamber so that the flame front radiates concentrically in combustion chamber 212. During the combustion process, the piston moves downwardly in the cylinder to provide a power stroke. As the piston approaches the bottom dead center, the cam 297 engages the roller 294 and moves exhaust valve 246 to the open position. The exhaust valve 246 remains open as the piston moves up in the combustion chamber to expel exhaust gases through the exhaust gas port 249, which leads to the atmosphere. The open exhaust port is a large annular opening that permits rapid purging of the exhaust gas from the combustion chamber.

While there has been shown and described the preferred embodiments of the concentric intake and exhaust valve assembly of the invention, it is understood that changes in the valve structures and structures for actuating the valve can be made by those skilled in the art without departing from the invention. The invention is defined in the following claims.

The embodiments of the invention in which an exclusive property or privilege is claimed are defined as follows:

1. An internal combustion engine comprising: a block having at least one cylindrical wall surrounding a combustion chamber, a piston means located in said combustion chamber, means operable to reciprocate the piston means in said chamber, a head means mounted on the block covering said chamber, said head means having an air and fuel intake passage and an exhaust gas passage, an intake and exhaust valve assembly mounted on the head means for controlling a flow of air and fuel into the chamber and a flow of exhaust gas from the combustion chamber, said valve assembly having an exhaust gas valve movably mounted on the head means for movement between an open position and a closed position for controlling the flow of the exhaust gas from the combustion chamber and an intake valve concentrically located relative to the exhaust gas valve movable to an open position and a closed position, a tubular member having a passage, means mounting the tubular member on the head means to align the tubular member with the combustion chamber, a spark plug mounted on the tubular member and located in said passage, said spark plug having electrodes exposed to the combustion chamber, said intake valve including a sleeve slidably mounted about the tubular member, an annular outwardly directed flange secured to the sleeve, said exhaust gas valve having an annular rim surrounding and engageable with the flange when the intake valve is closed, and means operable to sequentially move the intake valve and exhaust gas valve between their open and closed positions in timed relation with the movement of the piston means whereby said engine has an intake, compression, power, and exhaust strokes.

2. The engine of claim 1 wherein: the exhaust valve has a sleeve movably mounted on the head means, said head means having an annular seat surrounding an opening to the exhaust gas passage, said annular rim engageable with the seat when the exhaust valve is closed.

3. The engine of claim 1 wherein: the means operable to sequentially move the intake valve and exhaust valve comprise a pair of rocker arms, a push rod for each rocker arm, and cam means engageable with the push rods to impart movement thereto in response to movement of the means operable to reciprocate the piston means in said chamber.

4. The engine of claim 1 including: first biasing means for biasing the intake valve to its closed position, and second biasing means for biasing the exhaust gas valve to its closed position.

5. The engine of claim 1 wherein: the means mounting the tubular member on the head includes means to adjust a position of the tubular member relative to the combustion chamber whereby the location of the electrodes of the spark plug relative to the combustion chamber can be changed and the compression ratio of gas in the combustion chamber altered.

6. The engine of claim 1 wherein: the means to sequentially move the intake valve and the exhaust valve include first lever means operably connected to the intake valve, first cam means operably associated with the first lever to move the intake valve to its open position, first biasing means operable to bias and hold the intake valve in its closed position, second lever means operably connected to the exhaust gas valve, second cam means operably associated with the second lever to move the exhaust valve to its open position, and second biasing means operable to bias and hold the exhaust valve in its closed position, and drive means operably connecting the first and second cam means with the means operable to reciprocate the piston means.

7. The engine of claim 6 including: means connecting the first lever means to the first biasing means, and means connecting the second lever means to the second biasing means whereby the first and second lever means are operable to move the intake and exhaust gas valves between their open and closed postions.

8. The engine of claim 1 wherein: the exhaust gas valve has a first sleeve slidably mounted on the head means and an annular rim secured to the first sleeve, said rim engageable with a seat surrounding an opening in communication with the exhaust passage, said sleeve of the intake valve comprising a second sleeve located within and spaced from the first sleeve and an annular flange secured to the second sleeve, said flange being engageable with the rim when the intake valve is closed, said second sleeve being slidably mounted on the tubular member.

9. The engine of claim 8 wherein: the means to sequentially move the intake valve and exhaust gas valve include a first lever means operably connected to the first sleeve, first cam means operably associated with the first lever means to move the intake valve to an open position, first biasing means operable to bias and hold the intake valve in its closed position, second lever means operably connected to the second sleeve, second cam means operably associated with the second lever means to move the exhaust gas valve to its open position, and second biasing means operable to bias and hold the exhaust valve in its closed position, and drive means operably connecting the first and second cam means with the means operable to reciprocate the piston means.

10. The engine of claim 9 including: means connecting the first lever means to the first biasing means, and means connecting the second lever means to the second biasing means whereby the first and second lever means are operable to move the first and second sleeves between their open and closed positions.

11. An internal combustion engine comprising: a block having at least one cylindrical wall surrounding a combustion chamber, a piston means located in said combustion chamber, means operable to reciprocate the piston means in said chamber, a head means mounted on the block covering said chamber, said head means having an air and fuel intake passage and an exhaust gas passage, an intake and exhaust valve assembly mounted on the head means for controlling a flow of air and fuel into the chamber and a flow of exhaust gas from the combustion chamber, said valve assembly having an exhaust gas valve movably mounted on the head means for movement between an open position and a closed position for controlling the flow of the exhaust gas from the combustion chamber and an intake valve concentrically located relative to the exhaust valve movable to an open position and a closed position, said exhaust gas valve has a first sleeve slidably mounted on the head means and an annular rim secured to the sleeve, said rim engageable with a seat surrounding an opening in communication with the exhaust passage, said intake valve having a second sleeve located within and spaced from the first sleeve and an annular flange secured to the second sleeve, said flange being engageable with the rim when the intake valve is closed, and cylindrical means mounted on the head means, said second sleeve being slidably mounted on the cylindrical means, adjustable means mounting the cylindrical means on the head means whereby the position of the cylindrical means can be changed to vary the compression ratio of the gas in the combustion chamber, and means operable to sequentially move the intake valve and exhaust valve between their open and closed positions in timed relation with the movement of the piston means whereby said engine has an intake, compression, power, and exhaust strokes.

12. The assembly of claim 11 wherein: the cylindrical means is a tubular member extended toward the chamber, said tubular member having a passage, a spark plug located in the passage of the tubular member, said spark plug having electrodes exposed to the chamber, said sleeve being slidably mounted on the tubular member.

13. The assembly of claim 12 wherein: said adjustable means on the support mounts the tubular member in a selected adjusted position whereby a location of the electrodes of the spark plug relative to the chamber can be changed and the compression ratio of the gas in the chamber altered.

14. An intake and exhaust valve assembly movably mounted on a support for controlling a flow of gas into and out of a chamber comprising: first valve means adapted to be mounted on the support for controlling the flow of gas out of the chamber, said first valve means having a first sleeve and an annular rim secured to the sleeve, second valve means for controlling the flow of gas into the chamber, said second valve means being located within said first sleeve and having an annular means engageable with the rim when the second value means is in its closed position, said second valve means having a second sleeve located within and spaced from the first sleeve and an annular flange secured to the second sleeve, said flange being engageable with the rim when the second valve is closed, cylindrical means mounted on the support, said second sleeve being slidably mounted on the cylindrical means, and adjustable means mounting the cylindrical means on the support whereby the position of the cylindrical means can be changed to vary the compression ratio of the gas in the chamber.

15. The assembly of claim 14 including: first biasing means for biasing the first valve means to its closed position, and second biasing means for biasing the second valve means to its closed position.

16. The assembly of claim 14 including: means to ignite an air/fuel mixture in the chamber mounted on the cylindrical means.

17. The assembly of claim 14 including: means to sequentially move the first valve means and second valve means include first lever means operably connected to the sleeve, first cam means operably associated with the first lever means to move the first valve means to an open position, first biasing means operable to bias and hold the first valve means in its closed position, second lever means operably connected to the second valve means, second cam means operably associated with the second lever means to move the second valve means to its open position, and second biasing means operable to bias and hold the second valve means in its closed position.

18. The assembly of claim 17 including: means connecting the first lever means to the first biasing means, and means connecting the second lever means to the second biasing means whereby the first and second lever means are operable to move the first and second valve means between their open and closed positions.

19. An intake and exhaust valve assembly movably mounted on a support for controlling the flow of gas into and out of the chamber comprising: first valve means adapted to be mounted on the support for controlling the flow of gas out of the chamber, said first valve means having a sleeve and an annular rim secured to the sleeve, second valve means for controlling the flow of gas into the chamber, said second valve means being located within said sleeve and having an annular means engageable with the rim when the second valve means is in its closed position, a tubular member extended toward said chamber, means mounting the tubular member on the support, said tubular member having a passage, a spark plug located in the passage of the tubular member, said spark plug having electrodes exposed to the chamber, said sleeve being slidably mounted about the annular means.

20. The assembly of claim 19 wherein: said means mounting the tubular member on the support include adjustable means operable to selectively adjust the position of the tubular member on the support whereby a location of the electrodes of the spark plug relative to the chamber can be changed and the compression ratio of the gas in the chamber altered.

21. The assembly of claim 19 including: first biasing means for biasing the first valve means to its closed position, and second biasing means for biasing the second valve means to its closed position.

22. The assembly of claim 19 including: means to sequentially move the first valve means and the second valve means including first lever means operably connected to the sleeve, first cam means operably associated with the first lever means to move the first valve means to an open position, first biasing means operable to bias and hold the first lever means in its closed position, second lever means operably connected to the second valve means, second cam means operably associated with the second lever means to move the second valve means to its open position, and second biasing means operable to bias and hold the second valve means in its closed position.

23. The assembly of claim 22 including: means connecting the first lever means to the first biasing meas, and means connecting the second lever means to the second biasing means whereby the first and second lever means are operable to move the first and second valve means between their open and closed positions.

* * * * *

UNITED STATES PATENT AND TRADEMARK OFFICE

CERTIFICATE OF CORRECTION

PATENT NO. : 4,449,490

DATED : May 22, 1984

INVENTOR(S) : Craig N. Hansen

It is certified that error appears in the above-identified patent and that said Letters Patent is hereby corrected as shown below:

Column 3, line 18, "mainfold" should be --manifold--.

Column 6, line 50, "The" (third occurrence) should be --This--.

Column 10, line 15, "postions" should be --positions--.

Signed and Sealed this

*Twenty-third* Day of *October 1984*

[SEAL]

*Attest:*

GERALD J. MOSSINGHOFF

*Attesting Officer*

*Commissioner of Patents and Trademarks*